US007946656B2

(12) United States Patent
Hall et al.

(10) Patent No.: US 7,946,656 B2
(45) Date of Patent: May 24, 2011

(54) RETENTION SYSTEM

(75) Inventors: David R. Hall, Provo, UT (US); Scott Dahlgren, Alpine, UT (US); Jonathan Marshall, Provo, UT (US); Italo Elqueta, Lehi, UT (US); Tyson J. Wilde, Spanish Fork, UT (US); Christopher Durrand, Pleasant Grove, UT (US)

(73) Assignee: Schlumberger Technology Corporation, Houston, TX (US)

( * ) Notice: Subject to any disclaimer, the term of this patent is extended or adjusted under 35 U.S.C. 154(b) by 358 days.

(21) Appl. No.: 12/135,595

(22) Filed: Jun. 9, 2008

(65) Prior Publication Data

US 2009/0146489 A1 Jun. 11, 2009

Related U.S. Application Data

(63) Continuation of application No. 12/112,743, filed on Apr. 30, 2008, which is a continuation-in-part of application No. 12/051,738, filed on Mar. 19, 2008, now Pat. No. 7,669,674, which is a continuation-in-part of application No. 12/051,689, filed on Mar. 19, 2008, which is a continuation of application No. 12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/135,595, filed on Jun. 9, 2008, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/197* (2006.01)

(52) U.S. Cl. ..... 299/111; 299/113; 299/107

(58) Field of Classification Search ..... 299/104, 299/107, 105, 111, 113
See application file for complete search history.

(56) References Cited

U.S. PATENT DOCUMENTS 2,004,315 A 6/1935 Fean
2,124,438 A 7/1938 Struk et al.
3,342,531 A 9/1967 Krekeler
3,342,532 A 9/1967 Krekeler 3,254,392 A 6/1968 Novkov
3,397,012 A * 8/1968 Krekeler ..... 299/104
3,512,838 A 5/1970 Kniff
3,650,565 A 3/1972 Kniff
3,655,244 A 4/1972 Swisher
3,746,396 A 7/1973 Radd
3,807,804 A 4/1974 Kniff
3,830,321 A 8/1974 McKenry et al.
3,932,952 A 1/1976 Helton
3,942,838 A 3/1976 Bailey et al.
3,945,681 A 3/1976 White
3,957,307 A 5/1976 Varda
4,005,914 A 2/1977 Newman
4,006,936 A 2/1977 Crabiel
4,098,362 A 7/1978 Bonnice
4,109,737 A 8/1978 Bovenkerk
RE29,900 E 2/1979 Kniff
4,149,753 A 4/1979 Stoltz
4,156,329 A 5/1979 Daniels et al.
4,199,035 A 4/1980 Thompson
4,201,421 A 5/1980 Den Besten
4,247,150 A 1/1981 Wrulich et al.
4,268,089 A 5/1981 Spence et al.
4,277,106 A 7/1981 Sahley
4,397,362 A 8/1983 Dice et al.
4,439,250 A 3/1984 Acharya et al.
4,465,221 A 8/1984 Schmidt
4,484,644 A 11/1984 Cook
4,484,783 A 11/1984 Emmerich
4,489,986 A 12/1984 Dziak
4,497,520 A 2/1985 Ojanen
4,537,448 A 8/1985 Ketterer
4,583,786 A * 4/1986 Thorpe et al. ..... 299/81.3
4,627,665 A 12/1986 Ewing et al.
4,660,890 A 4/1987 Mills
4,678,237 A 7/1987 Collin
4,682,987 A 7/1987 Brady
4,684,176 A 8/1987 Den Besten et al.
4,688,656 A 8/1987 Elfgen
4,688,856 A 8/1987 Elfgen
4,694,918 A 9/1987 Hall
4,702,525 A 10/1987 Sollami et al.
4,725,098 A 2/1988 Beach
4,728,153 A 3/1988 Ojanen et al.
4,729,603 A 3/1988 Elfgen
4,746,379 A 5/1988 Rabinkin
4,765,686 A 8/1988 Adams
4,765,687 A 8/1988 Parrott
4,776,862 A 10/1988 Waind
4,804,231 A * 2/1989 Buljan et al. ..... 299/113
4,811,801 A 3/1989 Salesky et al.
4,836,614 A 6/1989 Ojanen
4,850,649 A 7/1989 Beach
4,880,154 A 11/1989 Tank
4,893,875 A 1/1990 Lonn et al.
4,921,310 A 5/1990 Hedlund
D308,683 S 6/1990 Meyers
4,932,723 A 6/1990 Mills
4,940,288 A 7/1990 Stiffler et al.
4,944,559 A 7/1990 Sionnet
4,951,762 A 8/1990 Lundell
4,956,238 A 9/1990 Griffin
5,007,685 A 4/1991 Beach et al.
5,011,515 A 4/1991 Frushour
5,018,793 A 5/1991 Den Besten
5,112,165 A 5/1992 Hedlund et al.
5,119,714 A 6/1992 Scott
5,141,289 A 8/1992 Stiffler
5,154,245 A 10/1992 Waldenstrom
5,186,892 A 2/1993 Pope
5,251,964 A 10/1993 Ojanen
5,261,499 A * 11/1993 Grubb ..... 299/107
5,303,984 A 4/1994 Ojanen
5,332,348 A 7/1994 Lemelson
5,333,938 A 8/1994 Gale
5,374,111 A 12/1994 Den Besten
5,415,462 A 5/1995 Massa et al.
5,417,475 A 5/1995 Graham
5,447,208 A 9/1995 Lund
5,503,463 A 4/1996 Ojanen
5,535,839 A 7/1996 Brady
5,542,993 A 8/1996 Rabinkin
5,653,300 A 8/1997 Lund
5,662,720 A 9/1997 O'Tigheamaigh
5,720,528 A 2/1998 Ritchey
5,725,283 A 3/1998 Montgomery, Jr.
5,738,698 A 4/1998 Kapoor et al.
5,823,632 A 10/1998 Burkett
5,837,071 A 11/1998 Andersson et al.
5,845,547 A 12/1998 Sollami
5,875,862 A 3/1999 Jurewicz
5,884,979 A 3/1999 Latham
5,890,552 A 4/1999 Scott
5,934,542 A 8/1999 Nakamura et al.
5,935,718 A 8/1999 Demo et al.
5,944,129 A 8/1999 Jenson
5,967,250 A 10/1999 Lund
5,992,405 A 11/1999 Sollami
6,000,483 A 12/1999 Jurewicz
6,006,846 A 12/1999 Tibbitts
6,019,434 A 2/2000 Emmerich
6,044,920 A 4/2000 Massa
6,051,079 A 4/2000 Andersson et al.
6,056,911 A 5/2000 Griffin
6,065,552 A 5/2000 Scott et al.
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,357,832 B1 3/2002 Sollami
6,364,420 B1 4/2002 Sollami
6,371,567 B1 4/2002 Sollami
6,375,272 B1 4/2002 Ojanen
6,419,278 B1 7/2002 Cunningham
6,460,637 B1 10/2002 Siracki
6,478,383 B1 11/2002 Ojanen
6,481,803 B2 11/2002 Ritchey
6,499,547 B2 12/2002 Scott
6,508,516 B1 1/2003 Kammerer
6,517,902 B2 2/2003 Drake
RE38,151 E 6/2003 Penkunas et al.
6,585,326 B2 7/2003 Sollami
6,601,662 B2 8/2003 Matthias
6,644,755 B1 11/2003 Kammerer
6,651,758 B2 11/2003 Xiang
6,685,273 B1 2/2004 Sollami
6,692,083 B2 2/2004 Latham
6,702,393 B2 3/2004 Mercier
6,709,065 B2 3/2004 Peay
6,719,074 B2 4/2004 Tsuda
6,732,914 B2 5/2004 Cadden
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,880,744 B2 4/2005 Noro
6,889,890 B2 5/2005 Yamazaki
6,962,395 B2 11/2005 Mouthaan
6,966,611 B1 11/2005 Sollami
6,994,404 B1 2/2006 Sollami
7,204,560 B2 4/2007 Mercier
7,369,743 B2 5/2008 Noro
7,387,345 B2 6/2008 Hall
7,390,066 B2 6/2008 Hall
7,413,258 B2 8/2008 Hall
2002/0070602 A1 6/2002 Sollami
2002/0074851 A1 6/2002 Montgomery
2002/0153175 A1 10/2002 Ojansen

| | | | |
|---|---|---|---|
| 2002/0175555 | A1 | 11/2002 | Mercier |
| 2003/0137185 | A1 | 7/2003 | Sollami |
| 2003/0141350 | A1 | 7/2003 | Noro et al. |
| 2003/0141753 | A1 | 7/2003 | Peay et al. |
| 2003/0209366 | A1 | 11/2003 | McAlvain |
| 2003/0230926 | A1 | 12/2003 | Mondy |
| 2003/0234280 | A1 | 12/2003 | Cadden et al. |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2005/0044987 | A1 | 3/2005 | Takayama et al. |
| 2005/0159840 | A1 | 7/2005 | Lin et al. |
| 2005/0173966 | A1 | 8/2005 | Mouthaan |
| 2006/0125306 | A1 | 6/2006 | Sollami |
| 2006/0237236 | A1 | 10/2006 | Sreshta |
| 2006/0261663 | A1 | 11/2006 | Sollami |

FOREIGN PATENT DOCUMENTS

| | | | |
|---|---|---|---|
| DE | 3431495 | | 3/1986 |
| DE | 3500261 | | 7/1986 |
| DE | 3818213 | | 11/1989 |
| DE | 4039217 | | 6/1992 |
| DE | 4039217 | A * | 6/1992 |
| DE | 19821147 | | 11/1999 |
| DE | 10163717 | | 5/2003 |
| EP | 0295151 | | 6/1988 |
| EP | 0412287 | | 7/1990 |
| EP | 1186744 | A2 | 3/2002 |
| EP | 1574309 | A1 * | 9/2005 |
| GB | 2004315 | | 3/1979 |
| GB | 2037223 | | 11/1979 |
| JP | 5280273 | | 10/1993 |

* cited by examiner

*Primary Examiner* — John Kreck

(74) *Attorney, Agent, or Firm* — Holme Roberts & Owen LLP

(57) ABSTRACT

A retention assembly, comprises a carbide bolster comprising a cavity formed in its base end. A shaft comprises an inserted end disposed within the cavity. The shaft is disposed within a hollow shank which comprises a first end contacting the bolster and a loaded end in mechanical communication with the shaft. Wherein, the inserted end is brazed to an inner surface of the cavity.

20 Claims, 16 Drawing Sheets

RETENTION SYSTEM

CROSS REFERENCE TO RELATED APPLICATIONS

This application is a continuation of U.S. patent application Ser. No. 12/112,743 filed on Apr. 30, 2008, which is a continuation-in-part of U.S. patent application Ser. No. 12/051,738 filed on Mar. 19, 2008, and is now U.S. Pat. No. 7,669,674 that issued on Mar. 2, 2010, which is a continuation-in-part of U.S. patent application Ser. No. 12/051,689 filed on Mar. 19, 2008, which is a continuation of U.S. patent application Ser. No. 12/051,586 filed on Mar. 19, 2008, which is a continuation in-part of U.S. patent application Ser. No. 12/021,051 filed on Jan. 28, 2008, which is a continuation-in-part of U.S. patent application Ser. No. 12/021,019 filed on Jan. 28, 2008, which was a continuation-in-part of U.S. patent application Ser. No. 11/971,965 filed on Jan. 10, 2008, and is now U.S. Pat. No. 7,648,210 that issued on Jan. 19, 2010, which is a continuation of U.S. patent application Ser. No. 11/947,644 filed on Nov. 29, 2007, which is a continuation-in-part of U.S. patent application Ser. No. 11/844,586 filed on Aug. 24, 2007, and is now U.S. Pat. No. 7,600,823 that issued on Oct. 13, 2009, U.S. patent application Ser. No. 11/844,586 is a continuation-in-part of U.S. patent application Ser. No. 11/829,761 filed on Jul. 27, 2007, and is now U.S. Pat. No. 7,722,127 that issued on May 25, 2010. U.S. patent application Ser. No. 11/829,761 is a continuation-in-part of U.S. patent application Ser. No. 11/773,271 filed on Jul. 3, 2007. U.S. patent application Ser. No. 11/773,271 is a continuation in-part of U.S. patent application Ser. No. 11/766,903 filed on Jul. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Feb. 14, 2008, and is now U.S. Pat. No. 7,475,948, that issued on Jan. 13, 2009. U.S. patent application Ser. No. 11/742,304 is a continuation of U.S. patent application Ser. No. 11/742,261 filed on Apr. 30, 2007, and is now U.S. Pat. No. 7,469,971 that issued on Dec. 30, 2008. U.S. patent application Ser. No. 11/742,261 is a continuation-in-part of U.S. patent application Ser. No. 11/464,008 filed on Aug. 11, 2006, and is now U.S. Pat. No. 7,338,135 that issued on Mar. 4, 2008. U.S. patent application Ser. No. 11/464,008 is a continuation-in-part of U.S. patent application Ser. No. 11/463,998 filed on Aug. 11, 2006, and is now U.S. Pat. No. 7,384,105 that issued on Jun. 10, 2008. U.S. patent application Ser. No. 11/463,998 is a continuation-in-part of U.S. patent application Ser. No. 11/463,990 filed on Aug. 11, 2006, and is now U.S. Pat. No. 7,320,505 that issued on Jan. 22, 2008. U.S. patent application Ser. No. 11/463,990 is a continuation in-part of U.S. patent application Ser. No. 11/463,975 filed on Aug. 11, 2006, and is now U.S. Pat. No. 7,445,294 that issued on Nov. 4, 2008. U.S. patent application Ser. No. 11/463,975 is a continuation-in-part of U.S. patent application Ser. No. 11/463,962 filed on Aug. 11, 2006, and is now U.S. Pat. No. 7,413,256 that issued on Aug. 19, 2008. U.S. patent application Ser. No. 11/463,962 is a continuation-in-part of U.S. patent application Ser. No. 11/463,953 filed on Aug. 11, 2006, and is now U.S. Pat. No. 7,464,993 that issued on Dec. 16, 2008. The present application is also a continuation-in-part of U.S. patent application Ser. No. 11/695,672 filed on Apr. 3, 2007, and is now U.S. Pat. No. 7,396,086. U.S. patent application Ser. No. 11/695,672 is a continuation-in-part of U.S. patent application Ser. No. 11/686,831 filed on Mar. 15, 2007, and is now U.S. Pat. No. 7,568,770. All of these applications are herein incorporated by reference for all that they contain.

BACKGROUND OF THE INVENTION

In the road construction and mining industries, rocks and pavement are degraded using attack tools. Often, a drum with an array of attack tools attached to it is rotated and moved so that the attack tools engage a paved surface or rock to be degraded. Because attack tools engage materials that may be abrasive, the attack tools may be susceptible to wear.

U.S. Pat. No. 6,733,087 to Hall et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a super hard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in the region of greatest variance.

Examples of degradation assemblies from the prior art are disclosed in U.S. Pat. No. 6,824,225 to Stiffler, U.S. Pub. No. 2005/0173966 to Mouthaan, U.S. Pat. No. 6,692,083 to Latham, U.S. Pat. No. 6,786,557 to Montgomery, Jr., U.S. Pub. No. 2003/0230926, U.S. Pat. No. 4,932,723 to Mills, U.S. Pub. No. 2002/0175555 to Merceir, U.S. Pat. No. 6,854,810 to Montgomery, Jr., and U.S. Pat. No. 6,851,758 to Beach, which are all herein incorporated by reference for all they contain.

BRIEF SUMMARY OF THE INVENTION

In one aspect of the invention a retention assembly has a carbide bolster comprising a cavity formed in its base end. A shaft comprises an inserted end disposed within the cavity. The shaft is disposed within a hollow shank which comprises a first end contacting the bolster and a loaded end in mechanical communication with the shaft and the inserted end is brazed to an inner surface of the cavity.

The shaft may be in mechanical communication with the loaded end through a threaded nut. The threaded nut may engage a shoulder of the shank. The brazed joint may comprise a braze material, such as copper, brass, lead, tin, silver, or combinations thereof. The inserted end of the shaft may be interlocked inside the cavity. The shaft, carbide bolster, and shank may be coaxial. The inserted end of the shaft may be brazed with the inner surface of the cavity of the bolster. The inserted end of the shaft may be adapted to compliment the ceiling of the bolster. The cavity may include a concave surface adapted to receive the shaft. The retention assembly may be incorporated into drill bits, shear bits, cone crushers, picks, hammer mills, or combinations thereof. The cavity of the bolster may comprise a thermal expansion relief groove. The interface between the inserted end of the shaft and the bolster may be non-planar. The inserted end of the shaft may comprise about a 1 to 15 degree taper. The inserted end of the shaft may comprise at least one thermal expansion relief groove. The thermal expansion relief grooves in the inserted end of the shaft may be adapted to receive the thermal expansion relief grooves in the cavity of the bolster. The inserted end of the shaft may be brazed to a top of the cavity. A tip made of carbide and diamond may be brazed to the bolster. An insert may be brazed into the cavity and the insert may retain the inserted end of the shaft. The insert and the inserted end may comprise a rounded interface. The retention assembly may be incorporated into a driving mechanism, a drum, a chain, or combinations thereof. The bolster may comprise an assembly brazed into the cavity and the assembly may comprise a pocket adapted to hold the inserted portion of the shaft.

In another aspect of the invention a retention assembly has a carbide bolster comprising a cavity formed in its base end. A shaft comprises an inserted end disposed within the cavity. The shaft is disposed within a hollow shank which comprises a first end contacting the bolster and a loaded end in mechanical communication with the shaft and the inserted end is interlocked within the geometry of the cavity by a casting.

The cast material may comprise metals such as zinc, aluminum, magnesium, thermosetting plastics, Bakelite, melamine resin, polyester resin, vulcanized rubber, or combination thereof. The shaft may be in mechanical communication with the loaded end through a threaded nut. The threaded nut may engage a shoulder of the shank. The inserted end of the shaft may comprise about a 1 to 15 degree taper. The inserted end of the shaft may comprise an increase in diameter. The shaft, carbide bolster, and shank may be coaxial. The inserted end of the shaft may include at least one groove formed in it surface. The retention assembly may be incorporated into drill bits, shear bits, hammer mills, cone crushers, or combinations thereof.

The inserted end of the shaft may compromise a shaft geometry adapted to interlock with the casting. The inner surface of the cavity of the bolster may comprise a cavity geometry adapted to interlock with the casting. The cavity geometry may comprise a taper narrowing towards an opening of the cavity formed in the base end. The diameter of the opening of the cavity formed in the base end is slightly smaller than the diameter of a tapered end of the shaft. The cavity geometry may comprise a lip. The inserted end of the shaft may be in contact with the cavity of the bolster. A tip of carbide and diamond may be brazed to the bolster. The retention assembly may be incorporated into a driving mechanism, a drum, a chain, a rotor, or combination thereof. The casting may cover at least the tapered end of the shaft.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following more detailed description of embodiments of the methods of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
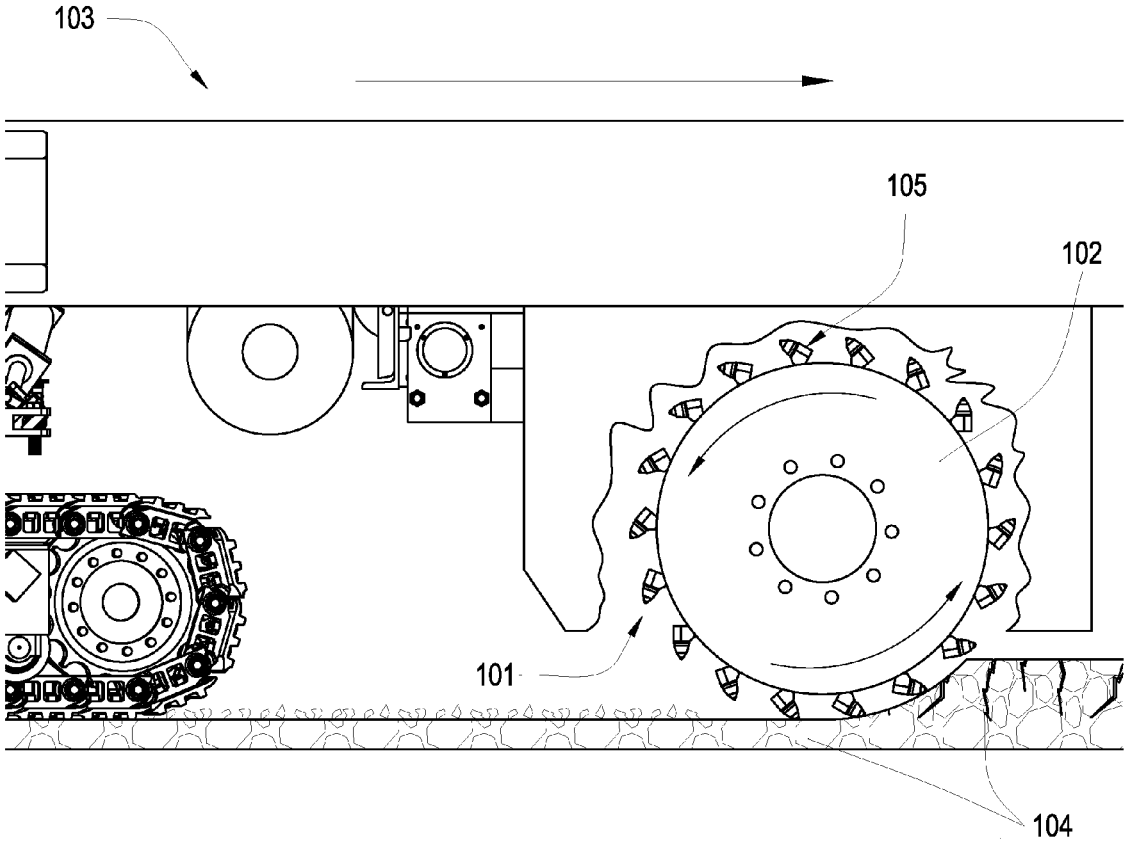
FIG. 1 is a cross-sectional view of one embodiment of the present invention showing a plurality of picks attached to the underside of a pavement milling machine.

FIG. 1 is a cross-sectional view of an embodiment of a plurality of picks 101 attached to a rotating drum 102 connected to the underside of a pavement milling machine 103. The pavement milling machine 103 may be a cold planer used to degrade man-made formations such as pavement 104 prior to the placement of a new layer of pavement 104. Picks 101 may be attached to the rotating drum 102 bringing the picks 101 into engagement with the formation, i.e., pavement 104.

Figure 2:
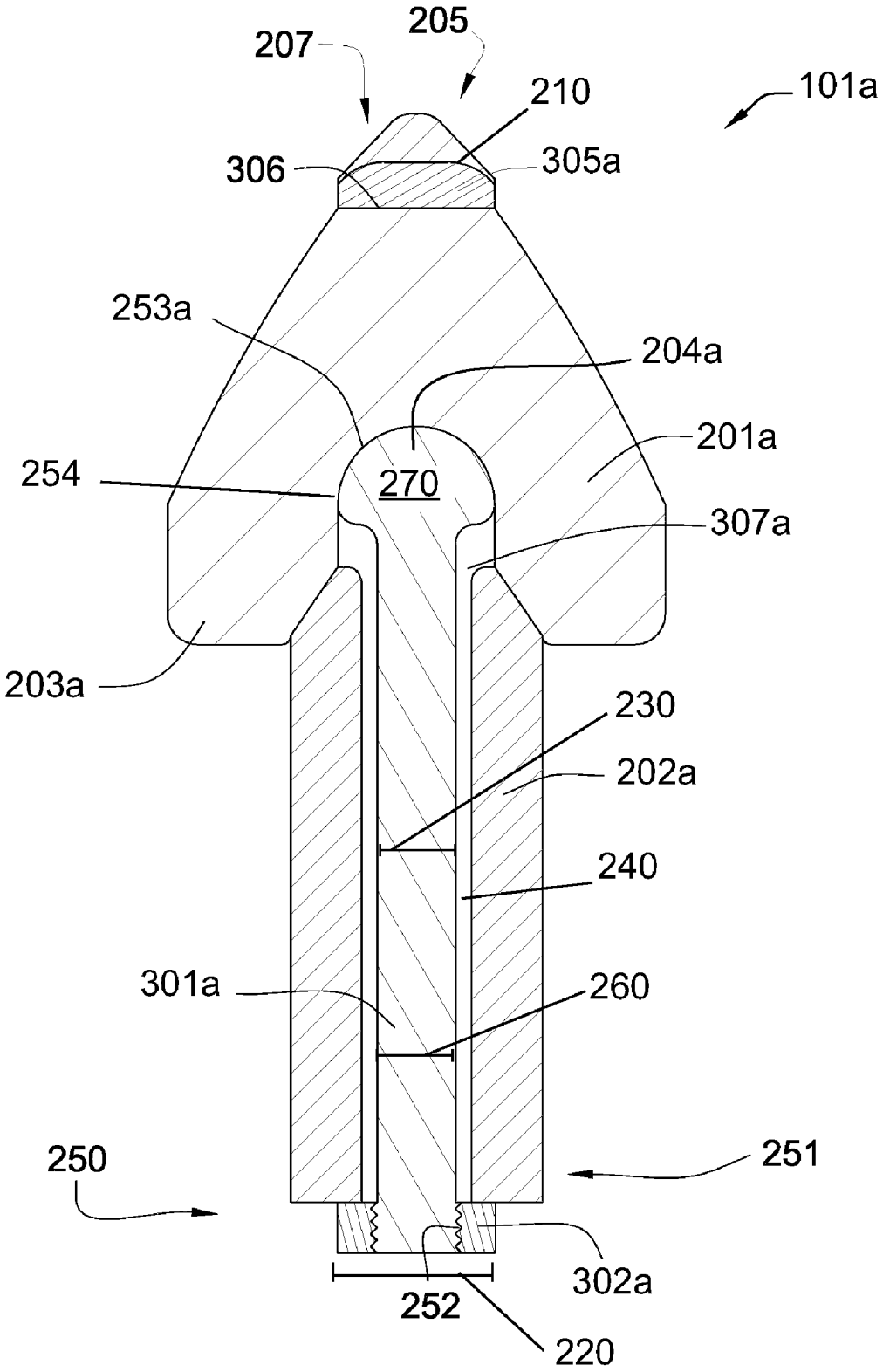
FIG. 2 is a cross-sectional view of one embodiment of a pick.

FIG. 2 is a cross-sectional view of an exemplary embodiment of a pick 101*a*. The pick 101*a* comprises a cemented metal carbide bolster 201*a* attached to a hollow shank 202*a* at a carbide base 203*a* of the carbide bolster 201*a*. The hollow shank 202*a* has a bore 240 with a diameter 260. The carbide bolster 201*a* may comprise tungsten carbide, calcium carbide, silicon carbide, cementite, boron carbide, tantalum carbide, titanium carbide or combination thereof. The hollow shank 202*a* may have a substantially cylindrical and/or tapered geometry.

An impact tip 205 may comprise a super hard material 207 bonded to a carbide substrate 305*a* at a non-planar interface 210. Preferably the carbide substrate 305*a* has an axial thickness less than 6 mm. In some embodiments, the carbide substrate 305*a* ranges between 10 and 1 mm. The super hard material 207 may be at least 0.100 inches thick axially, and in some embodiments, it may be over 0.250 inches. The super hard material 207 may be formed in a substantially conical shape.

Typically the carbide substrate 305*a* of the impact tip 205 is brazed to the carbide bolster 201*a* at a planar interface 306. The impact tip 205 and the carbide bolster 201 may be brazed together with a braze material comprising a melting temperature from 700 to 1200 degrees Celsius. The super hard material 207 may be bonded to the carbide substrate 305*a* through a high-temperature/high-pressure process (HTHP).

The super hard material 207 may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof.

A cavity 307*a* may be formed at the base end 203*a* of the bolster 201*a*. An inserted end 204*a* of a shaft 301*a* may be inserted into the cavity 307*a*. An other end 250 of the shaft 301*a* may be in mechanical communication with the loaded end 251 of the shank 202*a*. The other end 250*a* of the shaft 301*a* may comprise at least one thread 252 adapted to receive a threaded nut 302*a*. A threaded nut diameter 220 may be bigger than a shaft diameter 230 but smaller than the bore diameter 260.

The inserted end 204*a* of the shaft 301*a* may be brazed within the cavity 307*a* of the carbide bolster 201*a*. Preferably, a head 270 of the inserted end 204*a* comprises a geometry that compliments a geometry of the cavity 307*a*. Preferably, the head 270 of the inserted end 204*a* is brazed directly to a ceiling 253*a* of the cavity 307*a*. In other embodiments, the shaft 301*a* is brazed to a side wall 254 of the cavity 307*a*.

Figure 3:
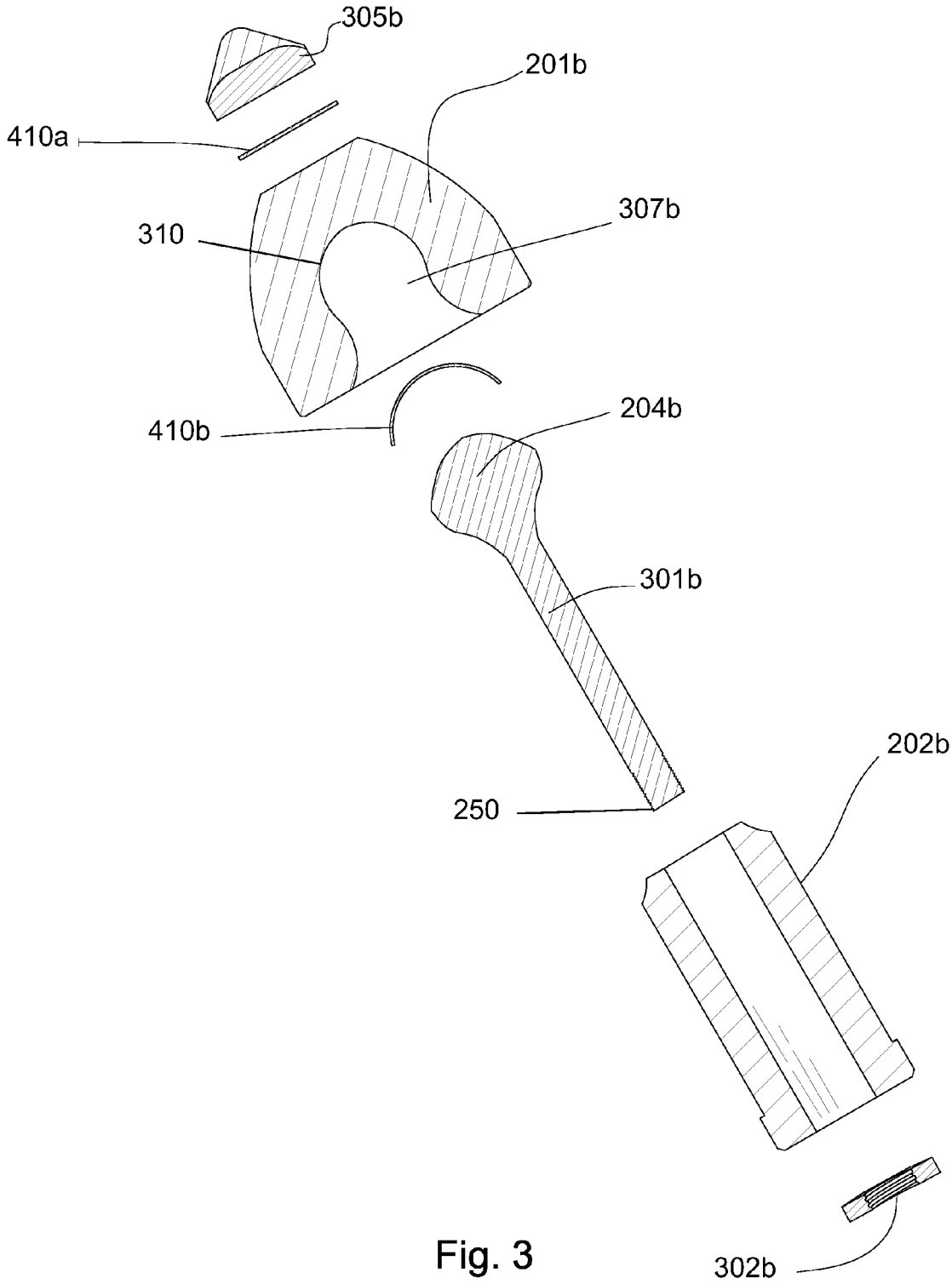
FIG. 3 is an exploded view of the pick shown in FIG. 2.

Referring now to the embodiment of FIG. 3, a carbide substrate 305*b* and a carbide bolster 201*b* may be brazed together at high temperature at the same time an inserted end 204*b* of a shaft 301*b* is brazed to a cavity 307*b*. The shaft 301*b* and the cavity 307*b* may be brazed at a non-planar interface 310. In some embodiments, the braze joints may be brazed at different times. In some embodiments, both braze joints utilize substantially similar braze materials 410*a* and 410*b*.

After brazing the inserted end 204*b* of the shaft 301*b* into the cavity 307*b*, an other end 250*b* of the shaft 301*b* may be tensioned through a hollow shank 202*b* and anchored while under tension with a threaded nut 302*b*. This tension loads the inserted end 204*b* of the shaft 301*b* and snuggly holds the carbide bolster 201*b* against the hollow shank 202*b*.

Figure 4:
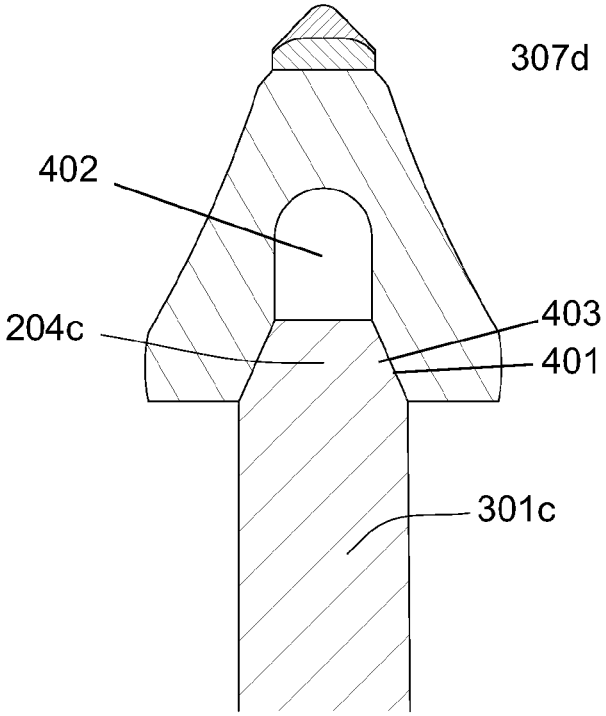
FIG. 4 is a cross-sectional view of another embodiment of a pick.

In the embodiment of FIG. 4, an inserted end 204*c* of a shaft 301*c* is tapered at shaft taper 403, which is adapted to abut a cavity taper 401 of the a cavity 402. The shaft taper 403 and the cavity taper 401 may be brazed together.

Figure 5:
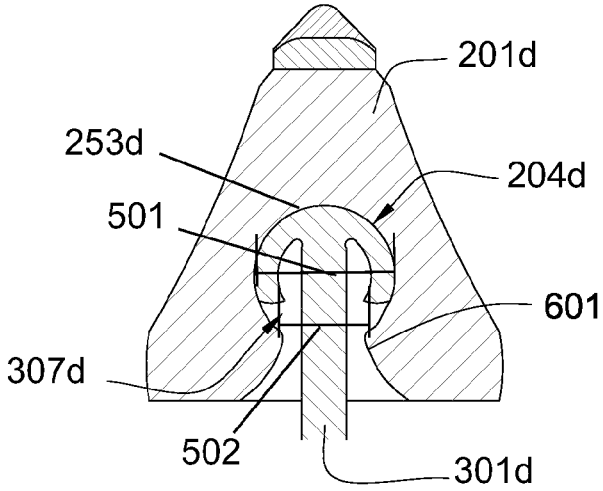
FIG. 5 is a cross-sectional view of another embodiment of a pick.

In the embodiment of FIG. 5, an inserted end 204*d* of a shaft 301*d* is brazed to a ceiling 253*d* of a cavity 307*d*. A diameter 501 of the inserted end 204*d* is larger than a diameter 502 of an opening constricted by a protruding lip 601 formed in the cavity 307*d*. The geometry of the inserted end 204*d* is adapted to flex upon insertion and snap out once past the lip 601. The inserted end 204*d* of the shaft 301*d* may be interlocked inside the cavity 307*d* of the carbide bolster 201*d*. The geometry of the inserted end 204*d* of the shaft 301*d* may allow enough space for thermal expansion while brazing the inserted end 301*d* to the cavity 307*d*.

Figure 6:
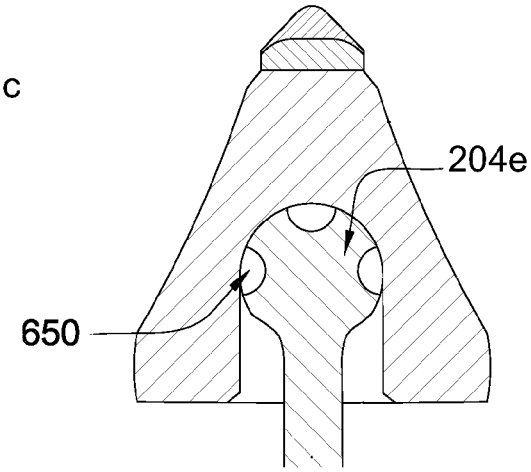
FIG. 6 is a cross-sectional view of another embodiment of a pick.

Referring now to the embodiment of FIG. 6, an inserted end 204*e* of the shaft 301*e* may comprise at least one relief groove 650 to allow space for thermal expansion during brazing. The at least one relief groove 650 may reduce residual stress that may develop during brazing.

Figure 7:
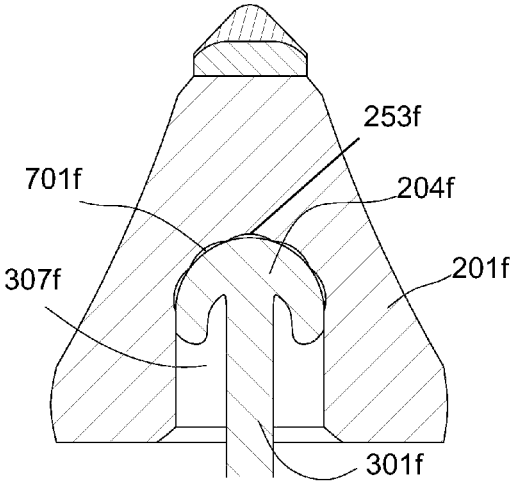
FIG. 7 is a cross-sectional view of another embodiment of a pick.

Referring now to the embodiment of FIG. 7, a ceiling 253*f* of the cavity 307*f* of a carbide bolster 201*f* may comprise at least one relief groove 701*f* to allow for thermal expansion during brazing. The at least one relief groove 701*f* may reduce residual stress that may develop during brazing. An inserted end 204*f* of a shaft 301*f* may be partially brazed to the ceiling 253*f* of the cavity 307*f* of the carbide bolster 201*f*.

Figure 8:
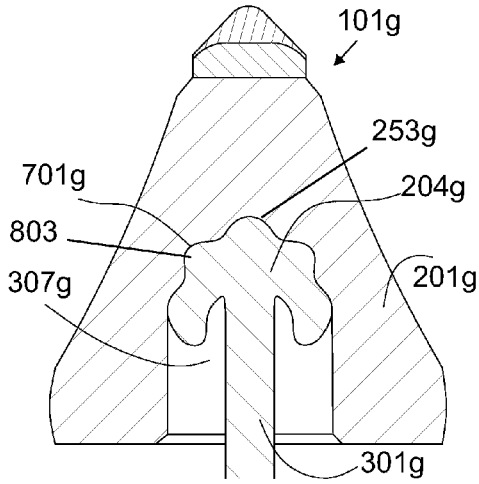
FIG. 8 is a cross-sectional view of another embodiment of a pick.

In FIG. 8 another embodiment of the invention is disclosed in which a pick 101*g* may comprise at least one groove 701*g* in a ceiling 253*g* of the a cavity 307*g* of a carbide bolster 201*g* adapted to receive protrusions 803 in an inserted end 204*g* of a shaft 301*g*. The ceiling 253*g* may be irregular and non-planar. The at least one groove 701*g* may form an interlocking mechanism with the protrusion 803. The at least one groove 701*g* may increase the surface area of the inserted end 204*g* and ceiling 253*g* allowing a larger braze joint.

Figure 9:
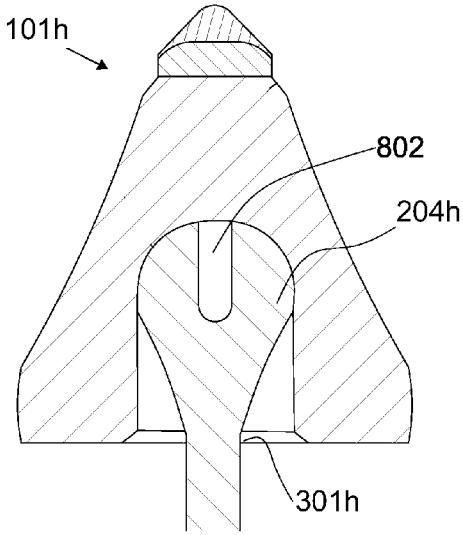
FIG. 9 is a cross-sectional view of another embodiment of a pick.

FIG. 9 is a cross-sectional view of another embodiment of a pick 101*h*. A relief opening 802 may be formed in an inserted end 204*h* of a shaft 301*h*The purpose of the relief opening 802 may be to allow enough space for thermal expansion while brazing.

Figure 10:
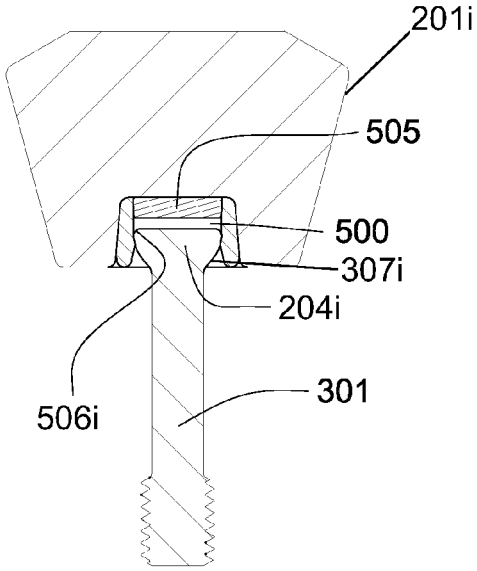
FIG. 10 is a cross sectional view of one embodiment of an insert brazed in the cavity of the bolster.

Referring now to FIG. 10, an insert 506*i* may be brazed into a cavity 307*i* of a carbide bolster 201*i*. The insert 506*i* may be adapted to retain an inserted end 204*i* of a shaft 301*i*, preferably in a ball and socket type of joint, although in some embodiments the joint may have a tapered or interlocked configuration. A cap 505 may be used in some embodiments to prevent a brazing material from flowing into the insert 506*i* and interfering with the joint. The solidification of the brazing material may restrict the compliancy of the joint during a bending moment induced in the carbide bolster 201*i* while in operation and create stress risers. The insert 506*i* and the inserted end 204*i* of the shaft 301*i* may comprise a rounded interface.

Figure 11:
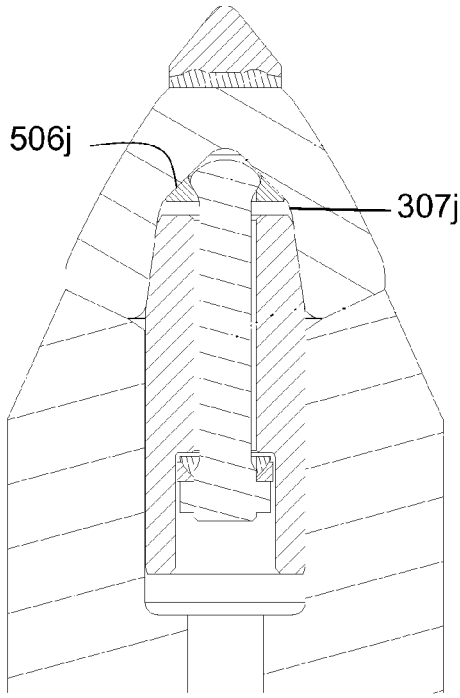
FIG. 11 is a cross-sectional view of another embodiment of an insert brazed in the cavity of the bolster.

In FIG. 11, another embodiment of an insert 506*j* brazed within a cavity 307*j* is shown.

Figure 12:
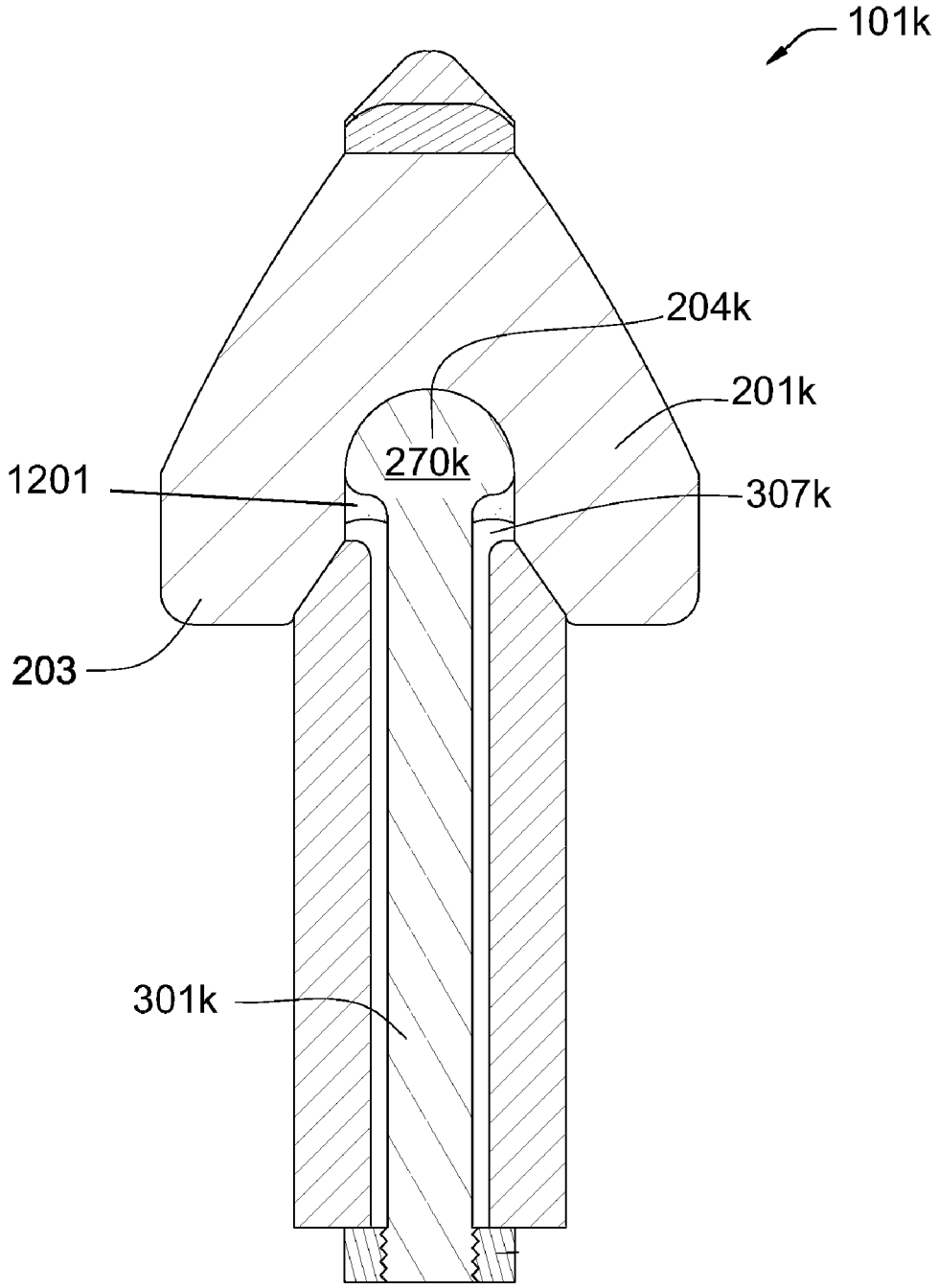
FIG. 12 is a cross-sectional diagram of another embodiment of a pick.

FIG. 12 is a cross-sectional view of another embodiment of a pick 101*k*. An inserted end 204*k* of a shaft 301*k* may be interlocked within a cavity 307*k* of a carbide bolster 201*k* by a cast material 120*l*. The cast material 120*l* may comprise zinc, a braze material, a plastic, lead, or combinations thereof. Zinc may be the preferred cast material since zinc will not significantly bond to the carbide and zinc demonstrates a high compressive strength. In some embodiments a non-wetting agent may be applied to a head 271*k* of the shaft 301*k* to prevent the zinc from forming a strong bond with the head 271*k* of the shaft 301*k*.

Figure 13:
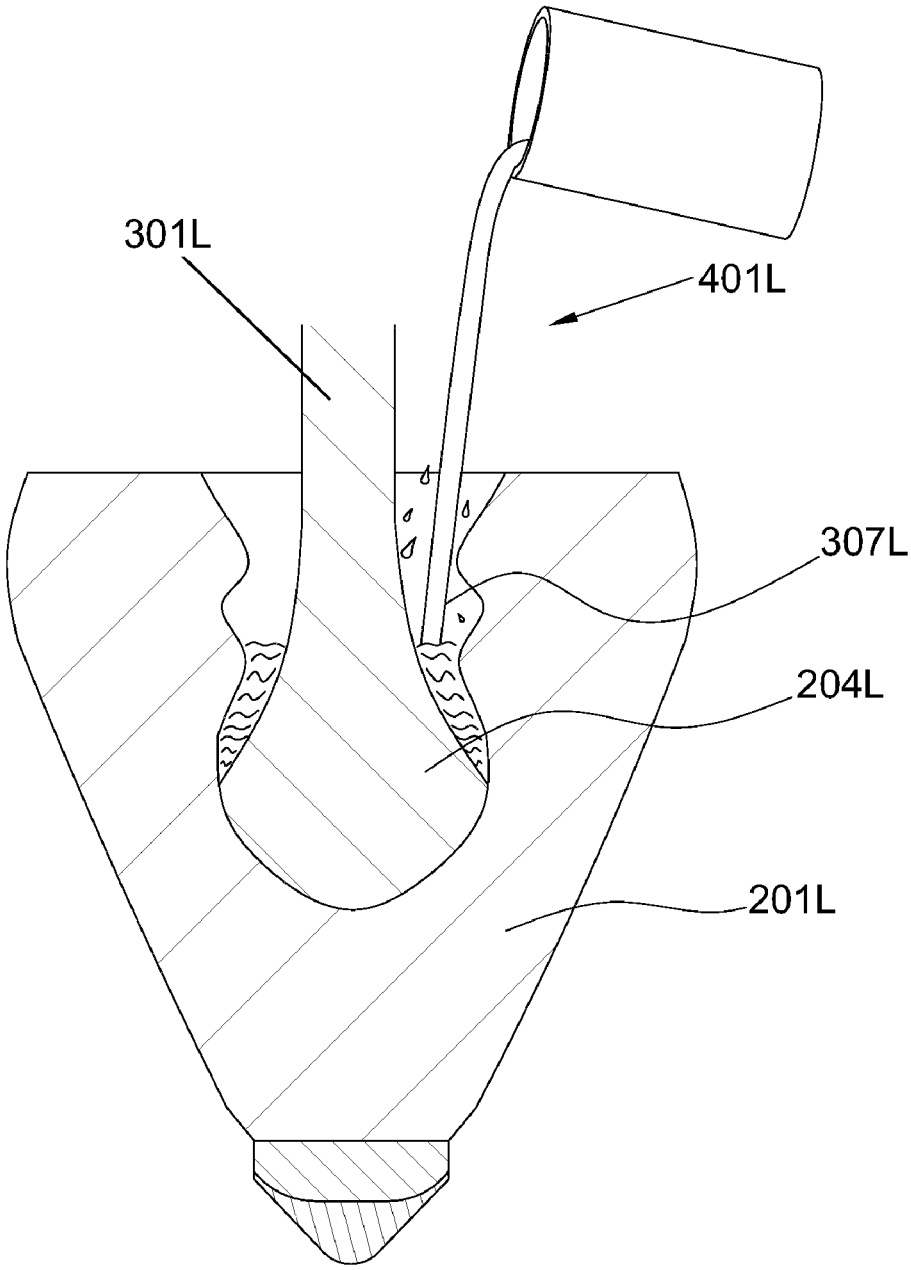
FIG. 13 is an exemplary illustration of a casting process.

In FIG. 13, an exemplary illustration of the casting process is shown. A tapered inserted end 204*l* of a shaft 301*l* may be brought into a cavity 307*l* and molten cast material 401*l* may be poured inside the cavity 307*l*. The molten cast material 401*l* then cools and solidifies. The cooling rate may vary depending on the cast material 401*l*. The rate at which a cast material 401*l* cools may affect the microstructure, quality, and properties of the cast material 401*l* and the mechanical interlocking of the cast material 401*l* with the shaft 301*l* and the geometry of the cavity 307*l*. The geometry of the cavity 307*l* of the carbide bolster 201*l* may provide additional support to ensure that the inserted end 204*l* of the shaft 301*l* remains interlocked within the cavity 307*l*.

In other embodiments, casting material granules, balls, shavings, segments, dust or combinations thereof may be placed in the cavity 307*l* with the inserted end 204*l* of the shaft 301*l* and melted in place. The cast material 401*l* may be heated in an oven, or a heating source such as a torch or radiant heater may be applied within the cavity 307*l* or applied to the outside of the carbide bolster 2011.

Figure 14:
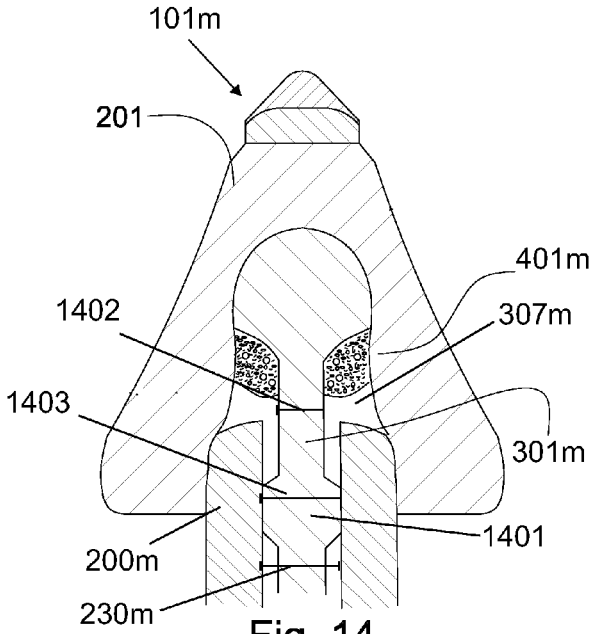
FIG. 14 is a cross-sectional view of one embodiment of a shaft casted within the cavity.

FIG. 14 is another embodiment of a pick 101*m*. A shaft 301*m* is disposed with a cavity 307*m* with cast material 401*m* cast within the cavity 307*m* proximate the shaft 301*m*. The shaft 301*m* includes a first diameter 1402 and a second diameter 1403 greater than said first diameter 1402 with the second diameter 1403 adapted to substantially contact an inner diameter 230*m* of the a hollow shank 202*m*.

Figure 15:
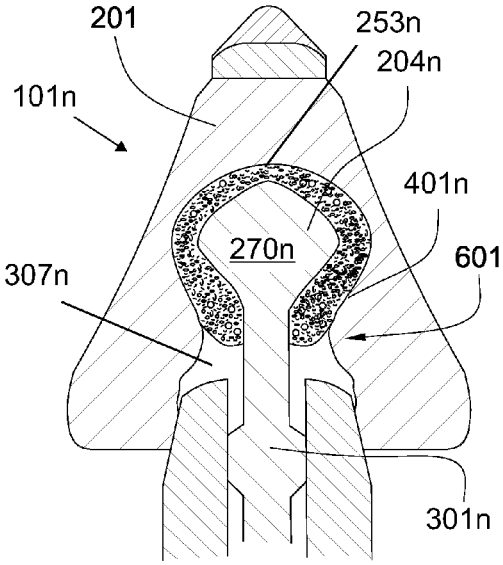
FIG. 15 is a cross-sectional view of another embodiment of a shaft casted within the cavity.

FIG. 15 is a cross-sectional diagram of another embodiment of a pick 101*n*. An inserted end 204*n* of a shaft 301*n* may or may not touch a ceiling 253*n* of the cavity 307*n*. The cast material 401*n* may form around an entire surface of a head 270*n* of the inserted end 204*n*.

Figure 16:
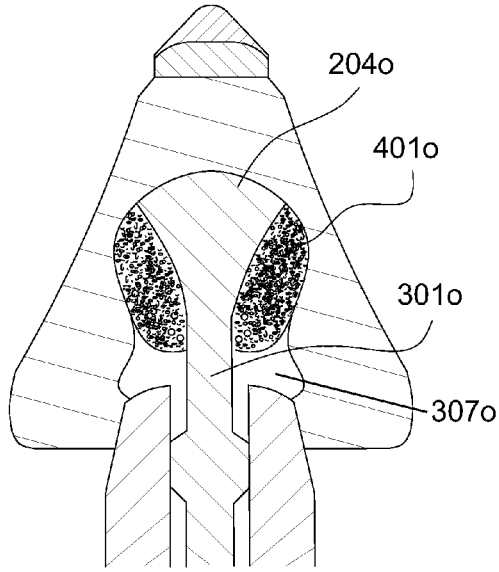
FIG. 16 is a cross-sectional view of another embodiment of a shaft casted within the cavity.

In the embodiment of FIG. 16, an inserted end 204*o* of a shaft 301*o* may be tapered to increase its surface area with the cast material 401*o*. In some embodiments, the taper is gradual and distributes the load substantially equally across an interface between the cast material 401*o* and the inserted end 104*o*. Another benefit of casting the cast material 401*o* with a shaft 301*o* in place is distributing the loads across substantially the entire inner surface of the a cavity 307*o*.

Figure 17:
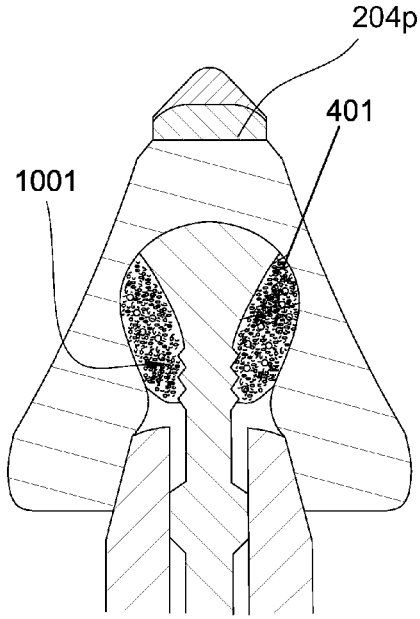
FIG. 17 is a cross-sectional view of another embodiment of a shaft casted within the cavity.

Referring now to the embodiment of FIG. 17, an inserted end 204*p* may comprise at least one groove 1001, and may be tapered. The groove 1001 may increase the grip between the inserted end 204*p* and the cast material 401*p*.

Figure 18:
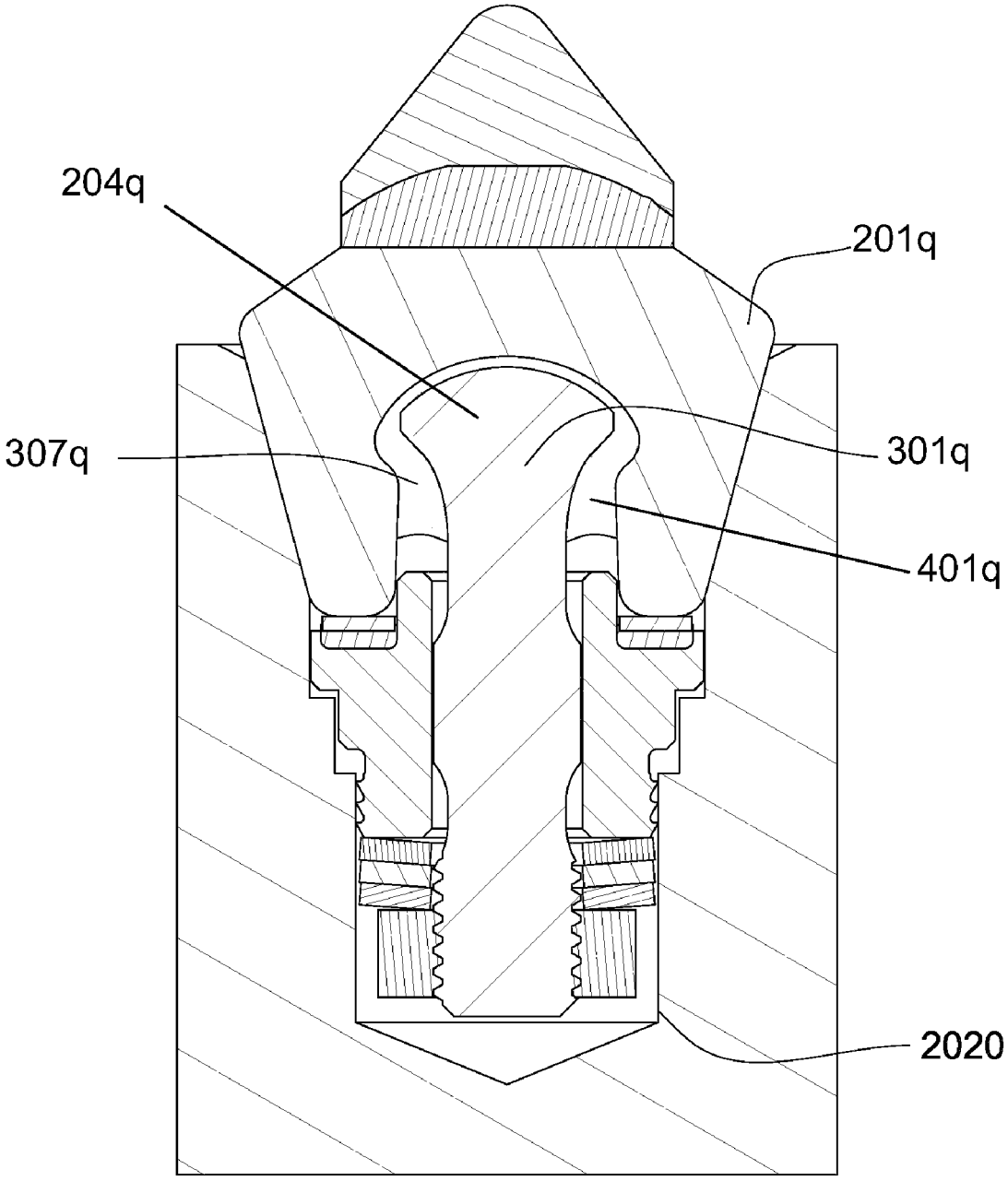
FIG. 18 is a cross-sectional view of one embodiment of a retention assembly.

FIG. 18 is a cross-sectional diagram of an embodiment of a degradation assembly inserted into a blind hole 2020 of a tool, such as a fixed cutter drill bit, percussion bit, roller cone bit, miller, crusher and/or mill. An inserted end 204*q* of a shaft 301*q* may be brought together with a cavity 307*q* of a bolster 201*q* by a cast material 401*q*.

Figure 19:
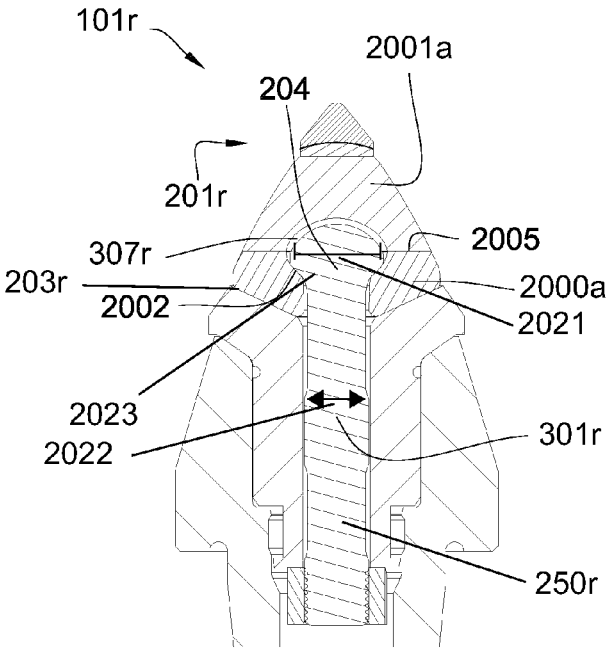
FIG. 19 is a cross-sectional view of another embodiment of a pick having two bolster segments.

FIG. 19 is another embodiment of a pick 101*r*. The carbide bolster 201*r* comprises a first segment 2000*a* and a second segment 2001*a*. Since carbide is a brittle material and shaft 301*r* is tensioned and therefore loading at least a portion of the carbide bolster 201*r*, a thick carbide lip 2002 is incorporated into this embodiment. The carbide bolster 201*r* is formed in two segments to allow insertion of an other end 250*r* of a shaft 301*r* through the carbide bolster 201*r* opposite a base end 203*r* of the carbide bolster 201*r*. The shaft 301*r* includes a shaft diameter 2022 and an inserted end diameter 2021 with a portion 2023 having an diameter 2023*a* greater than the shaft diameter 2022 and less than the inserted end diameter 2021 disposed between the shaft diameter 2022 and the inserted end diameter 2021. The portion 2023 interlocks with the lip 2002 of the first segment 2000*a*. The second segment 2001*a* of the carbide bolster 201 is brazed to the first segment 2000*a* after inserted end 204*r* is in place. Both the first segment 2000*a* and the second segment 2002*a* are made of similar materials reducing thermal stresses that are common in traditional picks.

In some embodiments, the second segment 2001*a* overhangs the first segment 2000*a*, directing debris away from a braze joint 2005 during a milling operation. The interface between the lip 2002 of the carbide bolster 201*r* and the inserted end 204*r* of the shaft 301*r* in some embodiments forms a joint that allows the inserted end 204*r* to swivel within a cavity 307*r*. This reduces the transfer of stress induced in the carbide bolster 201*r* during a bending moment to the shaft 301*r*.

In some embodiments, the shaft 301*r* may be casted, brazed, bonded, or combinations thereof in the cavity 307*r* after insertion.

In some embodiments, the inserted end 204*r* may be brazed in place while the first segment 2000*a* and the second segment 2001 a are brazed together. In other embodiments, while brazing the first segment 2000*a* and the second segment 2001*a* together the flow of the braze material is controlled to prevent the braze material from interfering with the shaft 301*r*. In some embodiments, the inserted end 204*r* of the shaft 301*r* is coated with boron nitride or another non-wetting agent to prevent the braze material from bonding to the inserted end 204*r* of the shaft 301*r*.

In some embodiments, the first segment 2000*a* and the second segment 2001*a* may be made of different carbide grades. The first segment 2000*a* may comprise a more wear resistant carbide grade while the second segment 2001*a* may comprise a tougher grade or vice versa.

Figure 20:
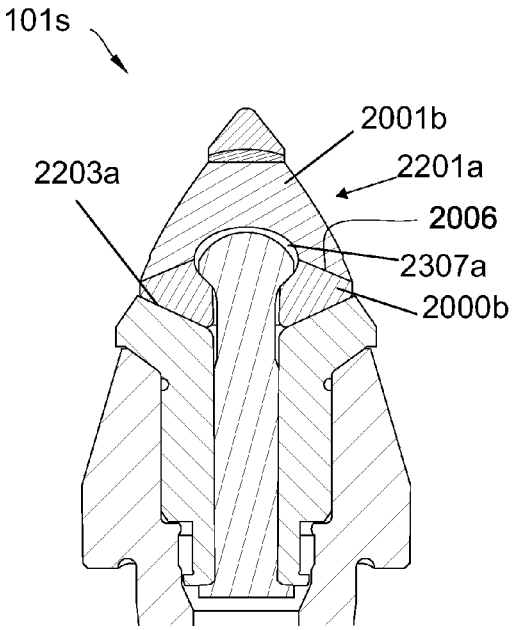
FIG. 20 is a cross-sectional view of another embodiment of a pick, showing a rearward braze joint.

The embodiment of FIG. 20 discloses an embodiment of a pick 101*s* that includes a carbide bolster 2201*a* including a rearward sloping braze joint 2006 between a first carbide segment 2000*b* and a second carbide segment 2001*b*. The rearward sloping braze joint 2006 extends towards a base end 2203*a* of a carbide bolster 2201*a* as the rearward sloping braze joint 2006 extends from a cavity 2307*a* of the carbide bolster 2201*b*.

Figure 21:
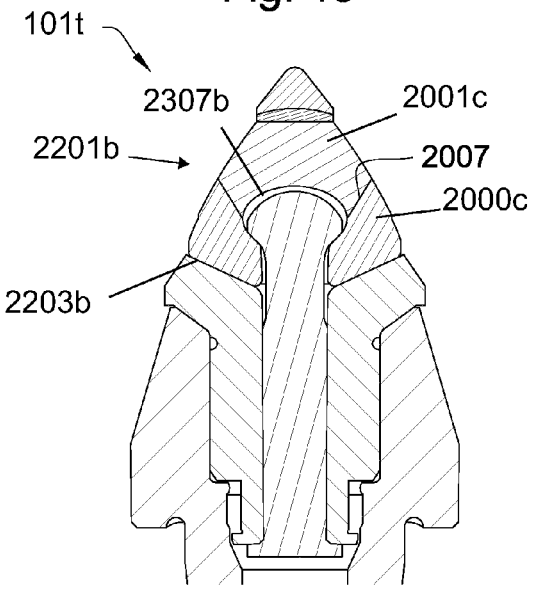
FIG. 21 is a cross-sectional view of another embodiment of a pick, showing a frontward braze joint.

The embodiment of FIG. 21 discloses an embodiment of a pick 101*t* that includes a carbide bolster 2201*b* including a frontward sloping braze joint 2007 between a first carbide segment 2000*c* and a second carbide segment 2001*c* in which the frontward sloping braze joint 2007 extends away from a base end 2203*b* of the carbide bolster 2201*b* as the frontward sloping braze joint 2007 extends from a cavity 2307*b* of the carbide bolster 2201*b*.

Figure 22:
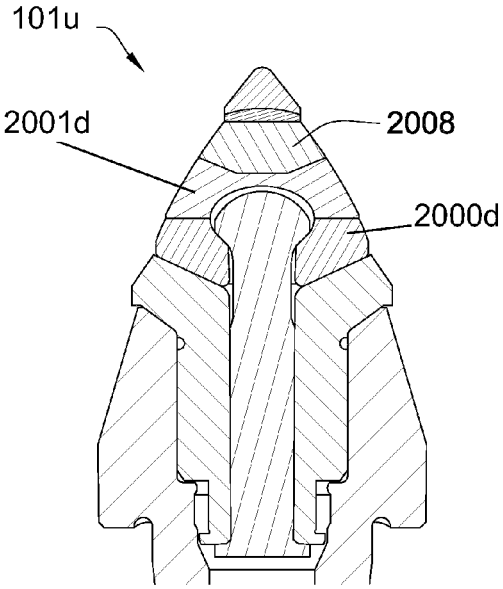
FIG. 22 is a cross-sectional view of another embodiment of a pick having three bolster segments.

The embodiment of FIG. 22 discloses an embodiment of a pick 101*u* that includes a third bolster segment 2008, in addition to a first bolster segment 2000*d* and a second bolster segment 2001*d*.

Figure 23:
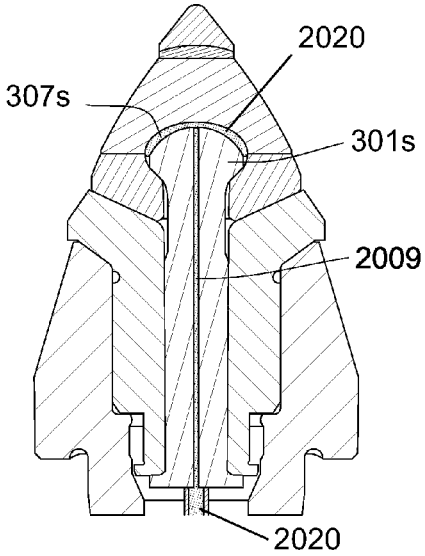
FIG. 23 is a cross-sectional view of another embodiment of a pick having a port adapted to provide lubrication to the cavity.

In some embodiments, a space within a cavity 307*s* may be lubricated. One such embodiment is disclosed in FIG. 23 where a port 2009 is formed in a shaft 301*s* to accommodate a flow of lubricant 2020 from a lubricant reservoir to the cavity 307*s*.

Figure 24:
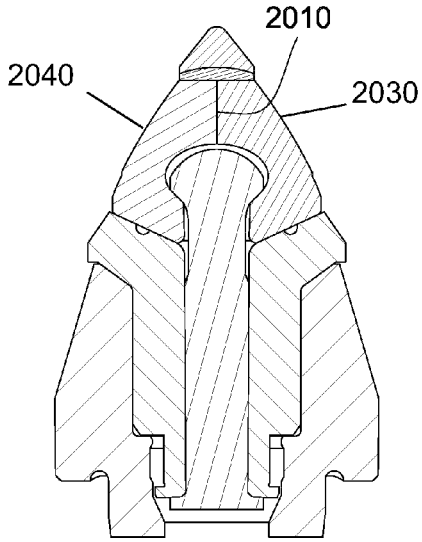
FIG. 24 is a cross-sectional view of another embodiment of a pick having an axial braze joint.

FIG. 24 discloses an embodiment in which a first carbide segment 2030 and a second carbide segment 2040 are bonded to one another along an axial braze joint 2010.

Figure 25:
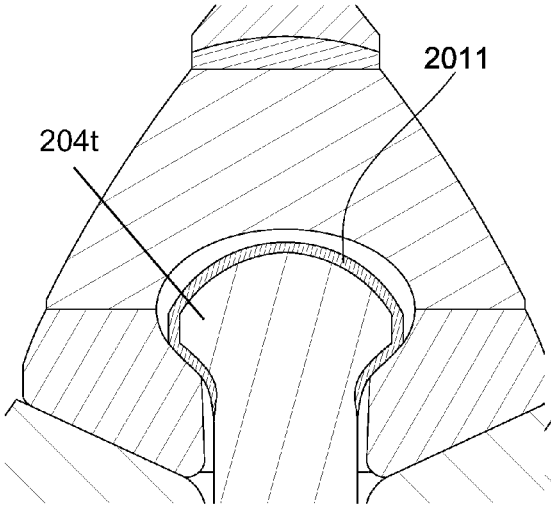
FIG. 25 is a cross-sectional view of another embodiment of a pick having a wear-resistant coating.

FIG. 25 discloses a wear resistant coating 201*l* deposited on an inserted end 204*t* to prevent wear.

Figure 26:
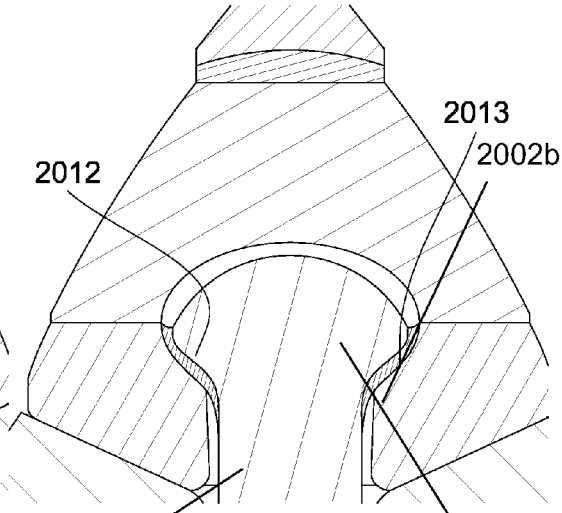
FIG. 26 is a cross-sectional view of another embodiment of a pick.

FIG. 26 discloses an embodiment including a braze joint 2012 between a lip 200*b* and an underside 2013 of an inserted end 204*u* of a shaft 301*u*.

Figure 27:
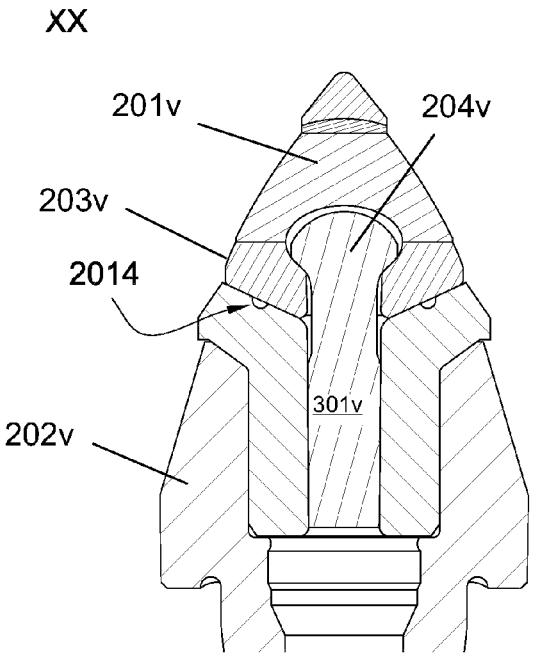
FIG. 27 is a cross-sectional view of another embodiment of a pick, showing a bolster that is adapted to rotate about the shaft.

FIG. 27 discloses an embodiment in which a carbide bolster 201*v* is adapted to rotate around an inserted end 204*v* of a shaft 301*v*. In such embodiments, an o-ring 2014 may be placed between a hollow shank 202*v* and a base end 203*v* of the carbide bolster 201*v*. The shaft 301*v* may be press fit into the hollow shank 202*v*. In some embodiments a shaft may protrude out of a solid shank (not shown). Wear resistant material and lubricants may be applied to the rotating surfaces. In FIG. 27, the shaft 301*v* is press fit within the hollow shank 202*v*.

Figure 28:
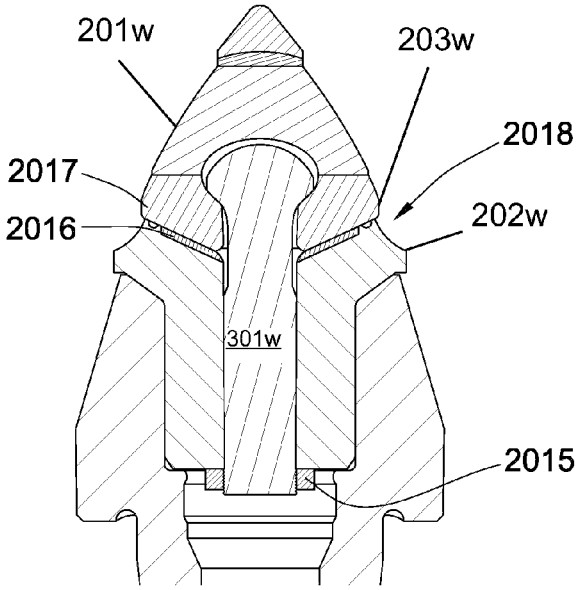
FIG. 28 is a cross-sectional view of another embodiment of a pick, showing a bolster that is adapted to rotate about the shaft.

The embodiment of FIG. 28 illustrates a shaft 301*w* that is tensioned and secured through a threaded nut 2015 on a loaded end 251*w* of a hollow shank 202*w*. A hardened washer 2016 is attached to the hollow shank 202*w* abutting a base end 203*w* of a bolster 201*w* to provide a bearing surface on which the bolster 201*w* may rotate. The bolster 201*w* also forms an overhang 2017 over the hollow shank 202*w* to direct debris away from the rotating interface 2018.

Figure 29:
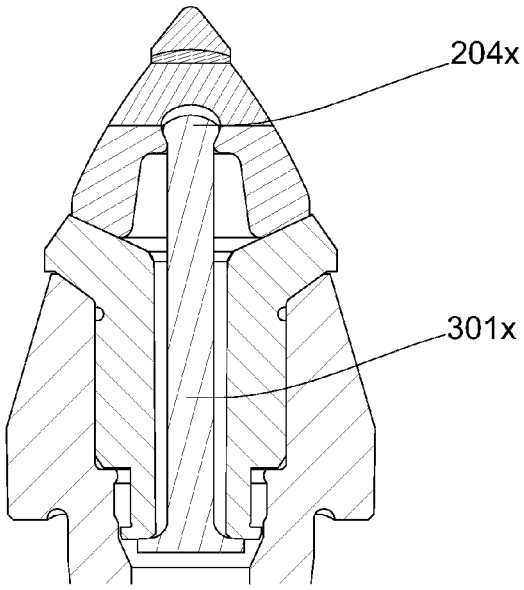
FIG. 29 is a cross-sectional view of another embodiment of a pick having a segmented bolster.

FIG. 29 is another embodiment of a segmented bolster 201*x* with an inserted end 204*x* of a shank 301*x* cast in place.

Figure 30:
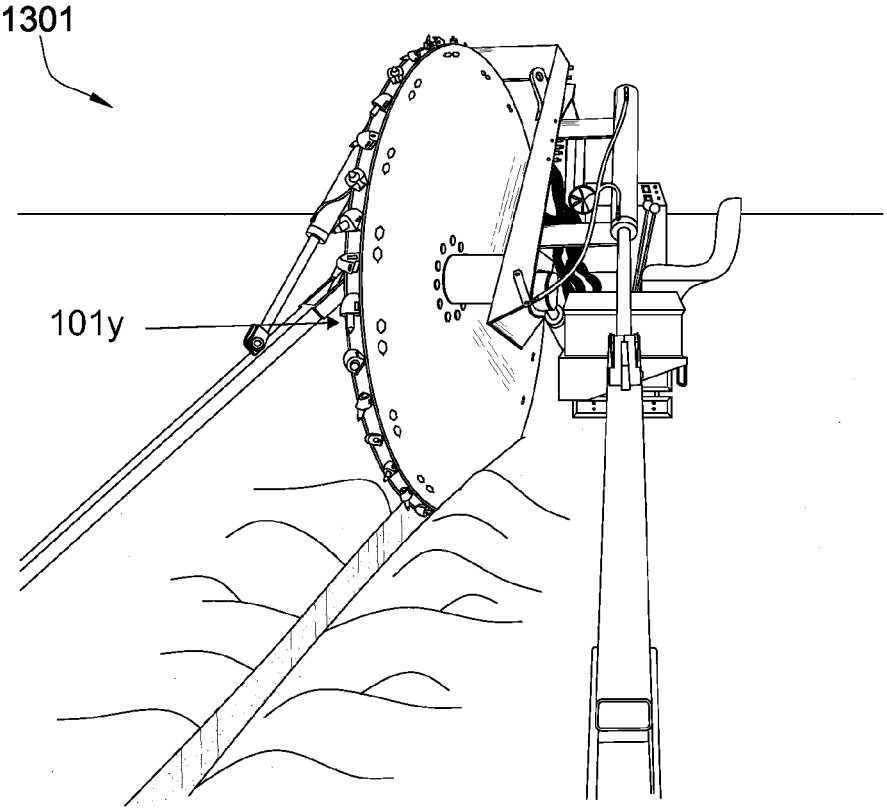
FIG. 30 is a perspective view of one embodiment of a pick on a trenching machine.

FIG. 30 is a perspective view of an embodiment of a pick 101*v*, such as pick 101 of FIG. 1, on a rock wheel trenching machine 1301.

Figure 31:
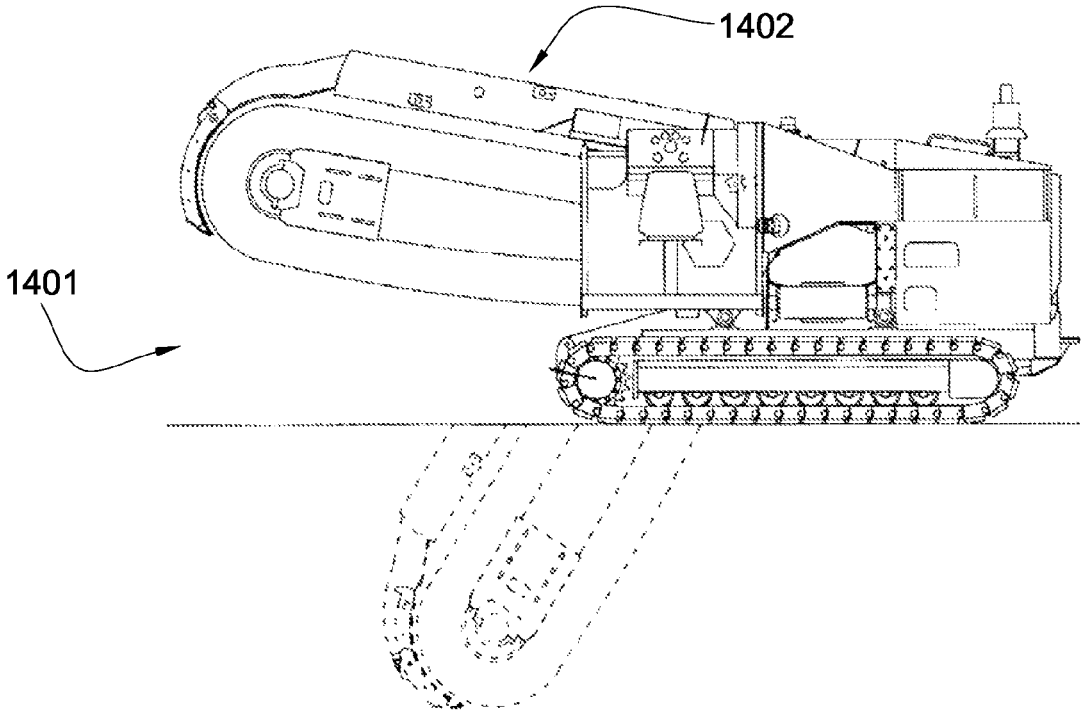
FIG. 31 is a side elevation view of another embodiment of a trencher pick on a trenching machine.

FIG. 31 is a view of an embodiment of a pick, such as pick 101 of FIG. 1 on a chain trenching machine 1401. The pick may be placed on a chain that rotates around an arm 1402 of chain trenching machine 1401.

Figure 32:
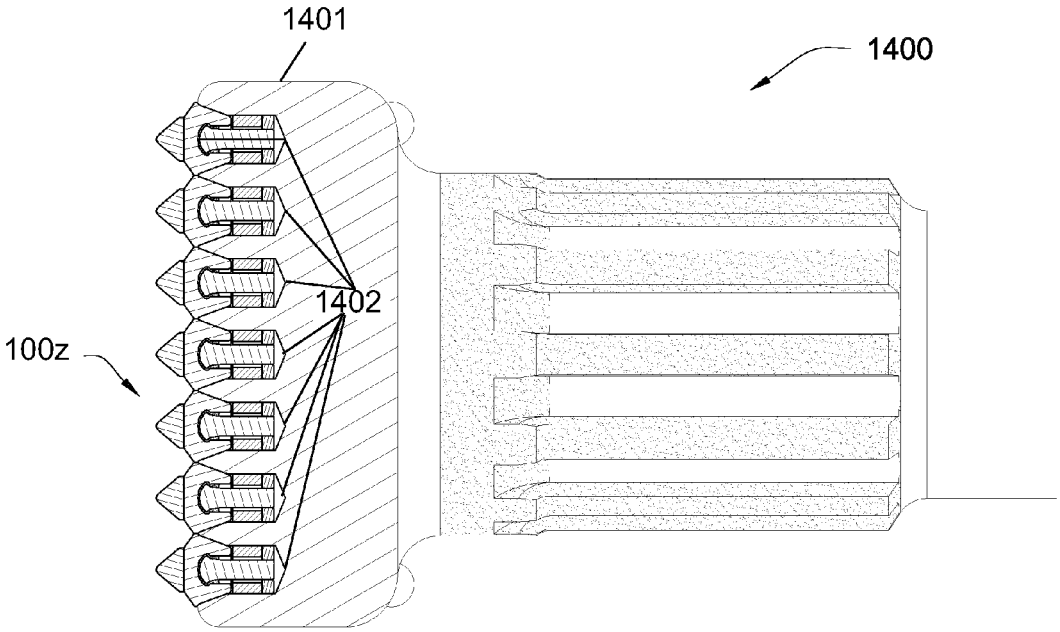
FIG. 32 is a cross-sectional view of one embodiment of a percussion bit adapted for receiving the picks.

In FIG. 32, a cross-sectional diagram of an embodiment of a percussion bit 1400 having a bit body 1401 with slots 1402 for receiving the picks 101*z*. The picks 101*z* may be anchored in the slots 1402 through a press fit, barbs, hooks, snap rings, or combinations thereof.

Figure 33:
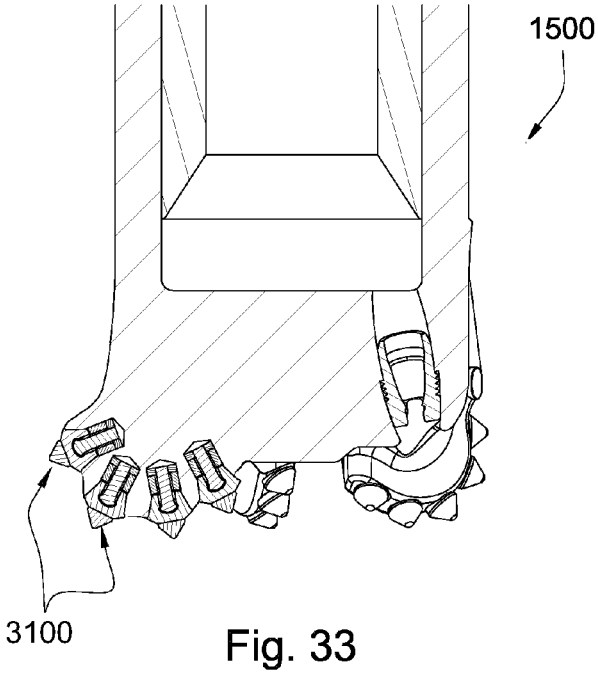
FIG. 33 is a cross-sectional view of one embodiment of a fixed cutter bit adapted to receive the picks.
Figure 34:
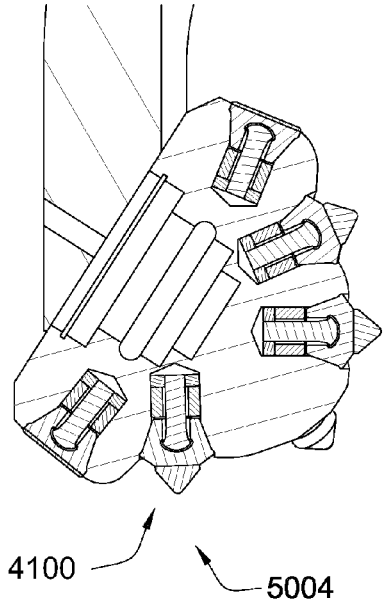
FIG. 34 is a cross-sectional view of one embodiment of the roller cone adapted to receive the picks.

FIG. 33 discloses another embodiment with picks 3100 in a fixed cutter bit 1500, FIG. 34 discloses another embodiment with picks 4100 in a cone 5004 of a roller cone bit.

Figure 35:
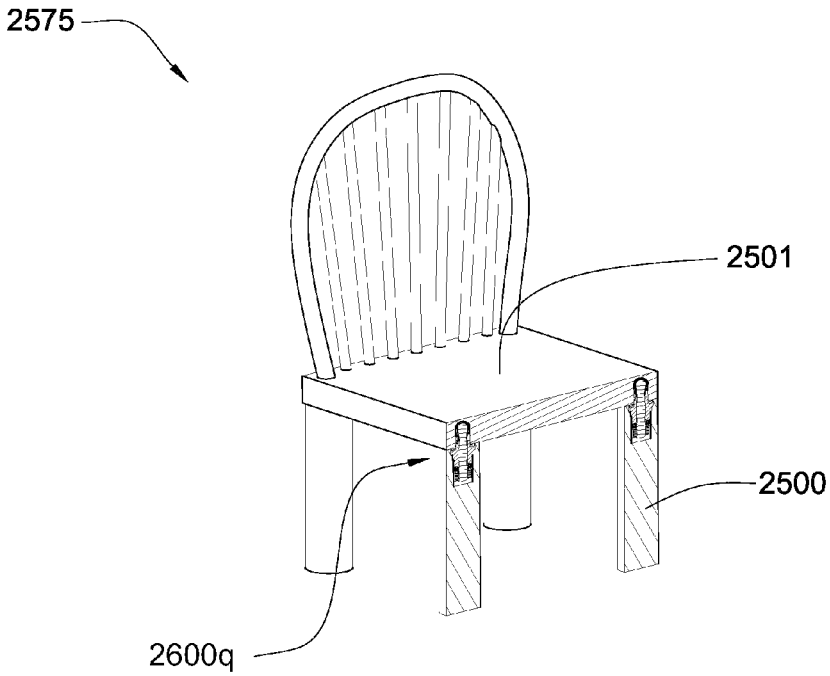
FIG. 35 is a perspective view of another embodiment of the retention assembly.

FIG. 35 is a perspective view of another embodiment of a retention assembly 2600*a*. The retention assembly 2600*a* may be used to bring two parts together such as two parts 2500 and 2501 of a chair.

Figure 36:
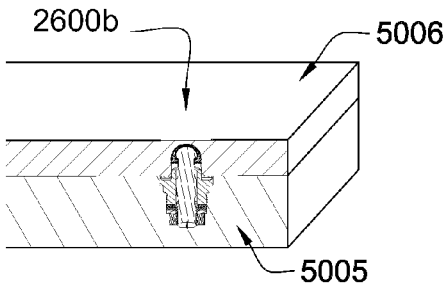
FIG. 36 is a cross-sectional view of another embodiment of a retention assembly.

Referring now to FIG. 36, a retention assembly 2600*b* may be used to connect two blocks 5005 and 5006 together.

Figure 37:
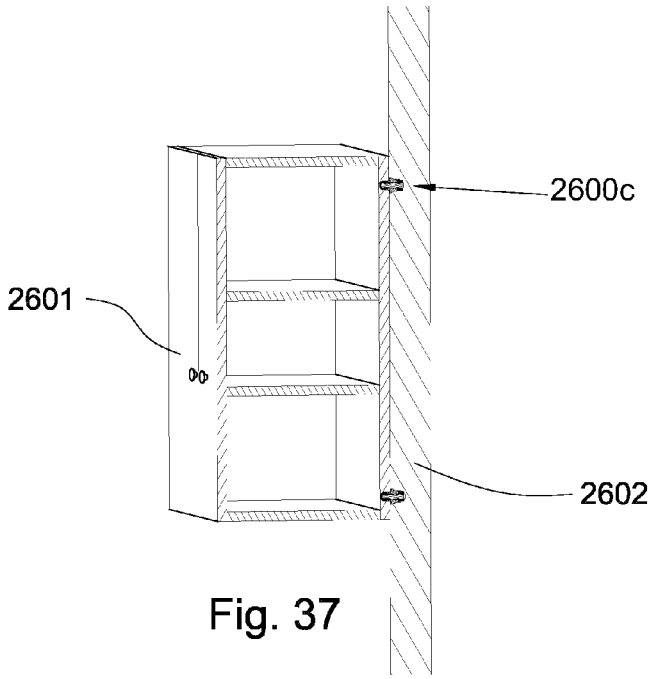
FIG. 37 is a perspective view of another embodiment of a retention assembly.

In FIG. 37 a retention assembly 2600*c* may be used to attach a block 2601 with a wall 2602.

Whereas the present invention has been described in particular relation to the drawings attached hereto, it should be understood that other and further modifications apart from those shown or suggested herein, may be made within the scope and spirit of the present invention.

What is claimed is:

1. A retention assembly, comprising:

a carbide bolster having a base end and including a cavity formed in the base end, the cavity having an inner surface;

a hollow shank including a first end contacting the carbide bolster and a loaded end spaced distant from the first end; and a shaft disposed within the hollow shank, the shaft being in mechanical communication with the loaded end of the hollow shank and including an inserted end disposed within the cavity and secured within the cavity by a braze joint between the inserted end and the inner surface.

2. The retention assembly of claim 1, wherein the shaft is in mechanical communication with the loaded end through a threaded nut.

3. The retention assembly of claim 2, wherein the threaded nut engages a shoulder of the hollow shank.

4. The retention assembly of claim 1, wherein the brazed joint includes a braze material including at least one of copper, brass, lead, tin and silver.

5. The retention assembly of claim 1, wherein the inserted end of the shaft is interlocked inside the cavity.

6. The retention assembly of claim 1, wherein the shaft, the carbide bolster and the hollow shank each have a central axis which are all substantially coaxial.

7. The retention assembly of claim 1, wherein the retention assembly is adapted for use in at least one of a drill bit, a shears bit, a cone crusher, a pick and a hammer mill.

8. The retention assembly of claim 1, wherein the cavity of the carbide bolster includes a thermal expansion relief groove.

9. The retention assembly of claim 1, wherein the inserted end of the shaft includes about a 1 to 15 degree taper.

10. The retention assembly of claim 1, wherein the inserted end of the shaft includes at least one thermal expansion relief groove.

11. The retention assembly of claim 1, wherein the inserted end of the shaft is brazed to a top end of the cavity.

12. The retention assembly of claim 1, wherein the inserted end of the shaft is brazed to a side of the cavity.

13. The retention assembly of claim 1, wherein a tip made of carbide and diamond is brazed to the carbide bolster.

14. The retention assembly of claim 1, wherein an insert is brazed into the cavity and wherein the insert retains the inserted end of the shaft.

15. The retention assembly of claim 14, wherein the insert and the inserted end include a rounded interface.

16. The retention assembly of claim 1, wherein the shaft is substantially isolated from bending moments induced in the carbide bolster.

17. The retention assembly of claim 1, wherein the retention assembly is adapted for use in at least one of a driving mechanism, a drum, a chain and a rotor.

18. The retention assembly of claim 1, wherein the carbide bolster includes a second assembly brazed into the cavity, the second assembly including a pocket adapted to hold the inserted end of the shaft.

19. The retention assembly of claim 1, wherein the cavity is formed by at least two segments of the carbide bolster.

20. A pick combination, comprising:

a carbide bolster including a top end and a base end, the base end having a cavity formed therein;

a shaft including a non-inserted end and an inserted end, the inserted end configured for insertion into the cavity; and a hollow shank surrounding the non-inserted end of the shaft and interconnected to the base end of the carbide bolster;

wherein the inserted end of the shaft is brazed to the cavity.

* * * * *